US005802804A

United States Patent [19]

Esposti et al.

[11] Patent Number: 5,802,804

[45] Date of Patent: Sep. 8, 1998

[54] SYSTEM FOR FEEDING ARTICLES TO BLISTERS OF A BLISTER BAND

[75] Inventors: Stefano Degli Esposti, Bologna; Mario Fossi, Funo; Vicinelli Stefano, S. Lazzaro di Savena, all of Italy

[73] Assignee: I.M.A. Industria Macchine Automatiche S.P.A., Ozzano Emilia, Italy

[21] Appl. No.: 849,086

[22] PCT Filed: Dec. 12, 1995

[86] PCT No.: PCT/IB95/01121

§ 371 Date: May 23, 1997

§ 102(e) Date: May 23, 1997

[87] PCT Pub. No.: WO96/18539

PCT Pub. Date: Jun. 20, 1996

[30] Foreign Application Priority Data

Dec. 16, 1994 [IT] Italy ..... BO94A0551

[51] Int. Cl.[6] ..... B65B 9/04; B65B 57/06

[52] U.S. Cl. ..... 53/55; 53/246; 53/505

[58] Field of Search ..... 53/55, 505, 493, 53/64, 67, 69, 246, 534, 158, 559, 560, 453

[56] References Cited

U.S. PATENT DOCUMENTS

| | | | |
|---|---|---|---|
| 2,139,041 | 12/1938 | Salfisberg | 53/158 X |
| 3,775,941 | 12/1973 | Bross | 53/246 |
| 5,010,712 | 4/1991 | Odenthal | 53/55 |
| 5,720,149 | 2/1998 | Stimpfl | 53/246 X |

FOREIGN PATENT DOCUMENTS

| | | |
|---|---|---|
| 0 163 043 | 12/1985 | European Pat. Off. . |
| 0 388 361 | 9/1990 | European Pat. Off. . |
| 2070508 | 9/1971 | France . |

*Primary Examiner*—James F. Coan

*Attorney, Agent, or Firm*—McAulay Fisher Nissen Goldberg & Kiel, LLP

[57] ABSTRACT

In a system for stepless feeding of articles (2) such as tablets, pills, capsules and the like, to blisters (41) of a blister band (4), moved in direction (M), placement means (3) are located between an article storage magazine (1) and the blister band (4) running thereunder. An outer cylindrical mantle (33) of the placement means is rotated by a brushless motor (5), in a direction (N) that is in accordance with the band motion direction (M). The mantle (33) features depressions (31) which receive articles from the magazine (1), and is rotated in phase relation with the movement of the band (4), so that in every moment, the position of the depressions (31) is in register with the position of the blisters (41) in the band (4). An electronic control unit controls in the brushless motor (5) by means of feed-back signals received from a position codifier (63) connected to a roller (60) that features recesses which are set in engagement with the blisters (41) so that the roller (60) rotates because of the movement of the band (4).

6 Claims, 4 Drawing Sheets

1
3
67
N
64
100
67
2
41
4
1
3
N

SYSTEM FOR FEEDING ARTICLES TO BLISTERS OF A BLISTER BAND

TECHNICAL FIELD

The present invention relates to automatic packaging of various articles, such as tablets, pills, capsules and the like, in blister packs, particularly useful for pharmaceutical or para-pharmaceutical products.

In detail, the present invention concerns an improved method for introducing the above mentioned articles in the blisters of a blister band.

BACKGROUND ART

It is known that preparation of blister packs includes the following steps: in a forming station, one or more rows of receptacles are made in a band of a suitable material, usually, plastic thermoweldable or aluminium material; this blister band passes to a filling station, where at least one article is introduced into each receptacle; the side with the receptacles is covered with aluminium film that is then sealed thereto.

The unit obtained in this way, is later cut to make portions containing a predetermined number of receptacles, i.e. articles.

Various apparatuses are known that use different methods to fill the receptacles of a blister band. One of these apparatuses includes a box-shaped container without the bottom, as wide as the blister band and located directly thereover.

The band is moved longitudinally with the receptacles oriented toward the container, so that they pass under it progressively.

A feeding channel supplies the container with articles to be introduced in receptacles in such an amount that they accumulate on the band surface. The accumulated articles tend to enter empty receptacles and translate with the band, thus leaving the container.

The remainder articles are constrained inside the same container. A system like the one described above, can be used with bands moving intermittently or continuously, without problems of alignment of the articles with respect to the correspondent receptacles.

This characteristics allows to use also bands with high elongation and shrinkage coefficients. In these cases, the distance between the receptacles may vary and depends on temperature changes that occur due to e.g. machine idle periods.

The use of the above mentioned materials is advisable also for other reasons. For example, polypropylene may be advantageously used because of its partial biodegradability. Otherwise, PVC (polyvinyl chloride) is commonly used because of its very low shrinkage coefficient, but it is not biodegradable.

However, the above described system brings about a series of problems concerning the filling technique. First of all, the articles, specially if very fragile, can be scratched or chipped by repeated pushes and rubber among the articles themselves and against the band surface or container walls.

Moreover, if the receptacles dimensions are too big with reference to the articles size, more than one article can be introduced into one receptacle.

Finally, using this system, it is not possible to introduce articles of different shape, dimension or composition into the receptacles of the same blister pack.

Another known apparatus includes a hopper, containing the articles in bulk and placed over the blister band. In its bottom, the hopper features a plurality of through holes, that allow the fall, due to gravity, of only one article at a time. The through holes are arranged to match the position of the receptacles in the blister band below.

A stencil, formed by a plate with holes, is placed between the hopper bottom and the blister band, that substantially touches it. The holes of the stencil match the receptacles, but are in misalignment with the holes of the hopper.

An intermediate element slides between the hopper and the stencil. This intermediate element features through holes, arranged like the hopper holes, that constitute temporary seats for the articles.

The dimension of these seats allow to contain only one article at a time. The intermediate element is reciprocated so as to shift from a position, in which the seats are coaxial with the hopper holes, to a position, in which these seats are coaxial with the stencil holes.

This apparatus can work in two different ways. In the first one, the blister band moves in steps. In this case, the hopper and the stencil are kept stationary.

During movement of the band, the intermediate element moves in direction opposite to the band direction, so as to set the band holes in alignment with the hopper holes, which makes one article fall inside each seat.

Then the band is stopped in a position, in which the first group of empty receptacles is brought under the stencil holes, and the intermediate element is shifted in the same direction of the band movement, until the seats are coaxial with the stencil holes. In this way, the articles contained in the seats fall into the respective empty receptacles.

According to the other operation mode, the blister band moves continuously and uniformly, while the hopper and the stencil move together, alternatively in the blister band direction and in the opposite one.

More precisely, in the filling step, the hopper and the stencil move in accordance with the band direction, and the stencil is brought to a position in which its holes match the first group of empty receptacles, while the intermediate element moves from a position, in which its seats are aligned with the hopper holes, to the position, in which the seats match the stencil holes.

In this way, the articles first fall to the respective seats of the intermediate element, and then, to the respective receptacles.

Afterwards,, the hopper and the stencil move together in direction opposite to the band advancement direction, until the stencil holes match the subsequent group of empty receptacles.

Meanwhile, the intermediate element moves with respect to the stencil and the hopper, so as to bring the seats in alignment with the hopper holes, and thus begin a new filling cycle.

A disadvantage of the above described apparatus results from the fact that the articles, specially if very fragile, can be damaged due to possible pushes against the holes edges.

In order to solve this problem, or at least minimise its effect, it is necessary to reduce the motion speeds of the hopper, the stencil and the intermediate element.

This results in another disadvantage, i.e. the machine throughput declines. If the articles to be inserted into the receptacles, have different dimensions, it is necessary to substitute the whole filling group.

Moreover, elongation and shrinkage of the band, which occur when materials with high temperature depending dimension variation coefficient are used, can jeopardise the receptacles alignment with the respective filling holes.

Finally, it is not possible to fill the receptacles of the same blister pack with articles of different shape or composition.

Yet another known method for filling the receptacles uses a plurality of feeding channels, in which the articles are piled. Each of the channels is situated in correspondence with a longitudinal row of receptacles made in the blister band.

The outlet of this channel touches the band surface and, due to the band movement, the articles fall inside the respective receptacles when they pass under the channel.

The articles are contained in bulk in a feeding device constituted by a vibrating drum, with the feeding parallel channels connected thereto.

The drum vibrations facilitate the articles descent in each channel. The characteristics of the above described solution allow to use blister bands made of materials with high temperature depending dimension variation coefficient, but limit its use in connection with other products.

In fact, also in this case, the receptacles which are bigger that the articles can be involuntarily filled with more articles.

Moreover, even if from a merely technical point of view it would be possible to insert articles of different types into the receptacles of the same blister pack, it is not advisable, or rather impossible, because of constructive complexity and high production costs.

DISCLOSURE OF THE INVENTION

An object of the present invention is to propose a system for feeding articles such as tablets, pills and the like, improved so as to guarantee perfect filling of each receptacle with a predetermined number of articles, avoiding possible damages to either the articles or the blister band, independently from the shape and the size of the articles and the receptacles.

Another important object of the present invention is to propose a method for feeding articles the reliability and throughput of which do not change even if blister bands used are made of materials with high temperature depending dimension variation coefficient, that is important taking into consideration the changes of temperature that occur during the machine normal working and idle periods.

Further object of the present invention is the possibility to use blister bands made of any material and to feed the blister bands with articles of different shapes or composition.

Still a further object of the present invention is to allow to adjust in a simple way the machine so that it complies with all possible productivity requirements.

The above mentioned objects are obtained by means of a system for feeding articles to blisters of a blister band, the system that includes one or more article storage magazines, each one formed by a basically vertical channel with open bottom, and containing a pile of articles to be introduced into relative blisters of a blister band that is located under this magazine and driven in a straight direction. This system has been improved and includes: placement means, for taking cyclically at least one article from the bottom of the magazine and for introducing it into a respective blister, said placement means being located between the magazine and the blister band, and rotated in a direction that is in accordance with movement direction of the band and in phase relation therewith; a plurality of depressions made on an outer surface of said placement means; a motor, controlled by an electronic control unit for driving said placement means into rotation; feedback control means, electronically connected with the said control unit, for detecting the position of the blisters and for operating said motor to carry out a precise introduction of the articles into respective blisters.

BRIEF DESCRIPTION OF THE DRAWINGS

The characteristic features of the present invention are pointed out in the following description with reference to the enclosed drawings, in which.

BEST MODE OF CARRYING OUT THE INVENTION

Figure 1:
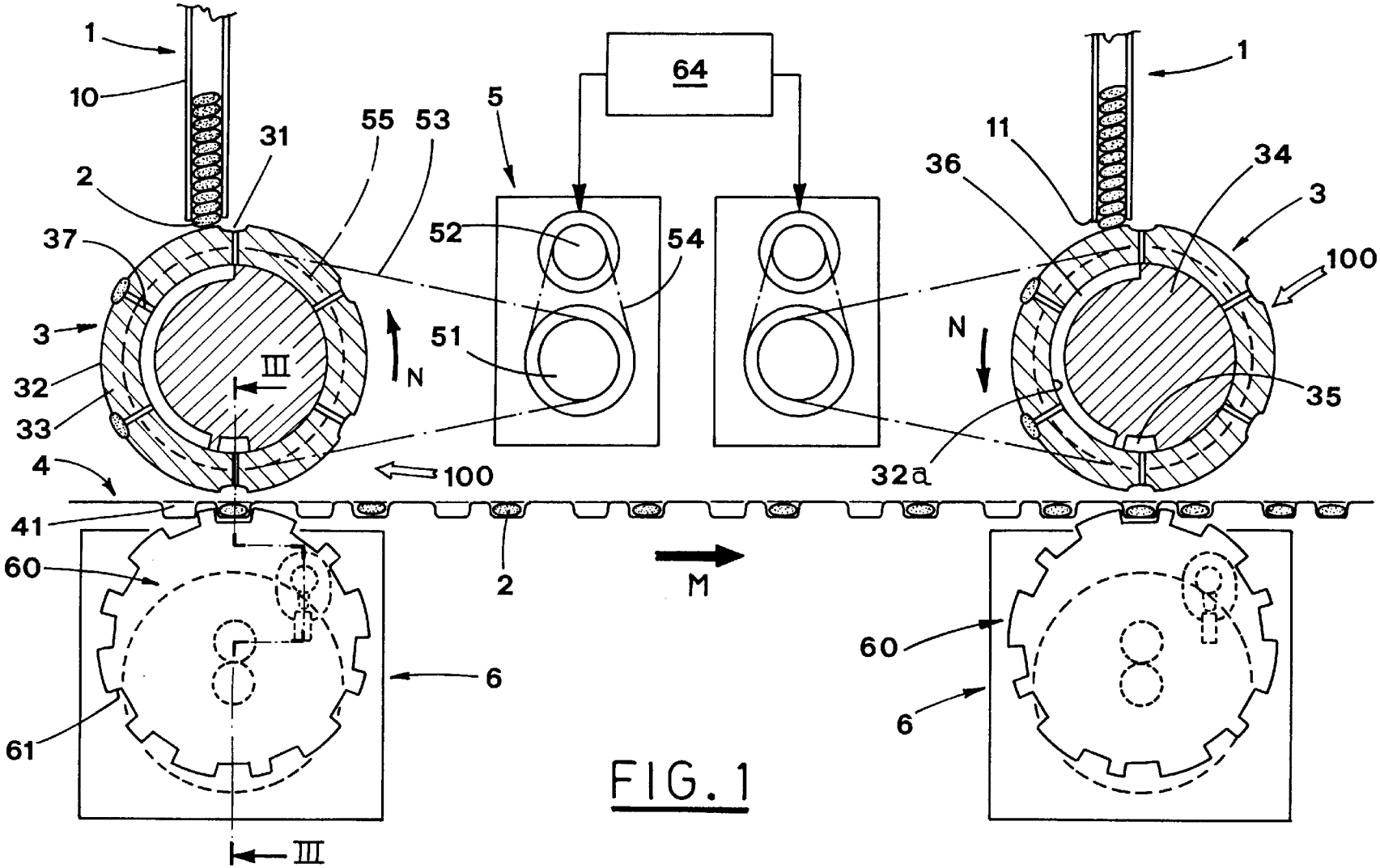
FIG. 1 is a side schematic section of a preferred embodiment of the system for feeding articles to blister bands according to the present invention.

With reference to the figures, numeral 100 indicates a station provided in a blister packaging machine for feeding articles 2.

The station 100 includes a storage magazine 1, which is formed by a basically vertical channel 10, and which has an open bottom 11.

A pile of articles 2 to be introduced into relative blisters 41 of a blister band 4, is located inside the magazine 1.

The articles 2 are usually pharmaceutical or para-pharmaceutical products, such as tablets, capsules or pills.

The blister band 4 is constituted by a continuous sheet, usually of thermoformable material, like PVC (polyvinyl chloride) o polypropylene or others, that comes from a forming station, not shown, and driven to a linear, uniform movement in horizontal direction M, by known, not illustrated driving means.

Figure 2:
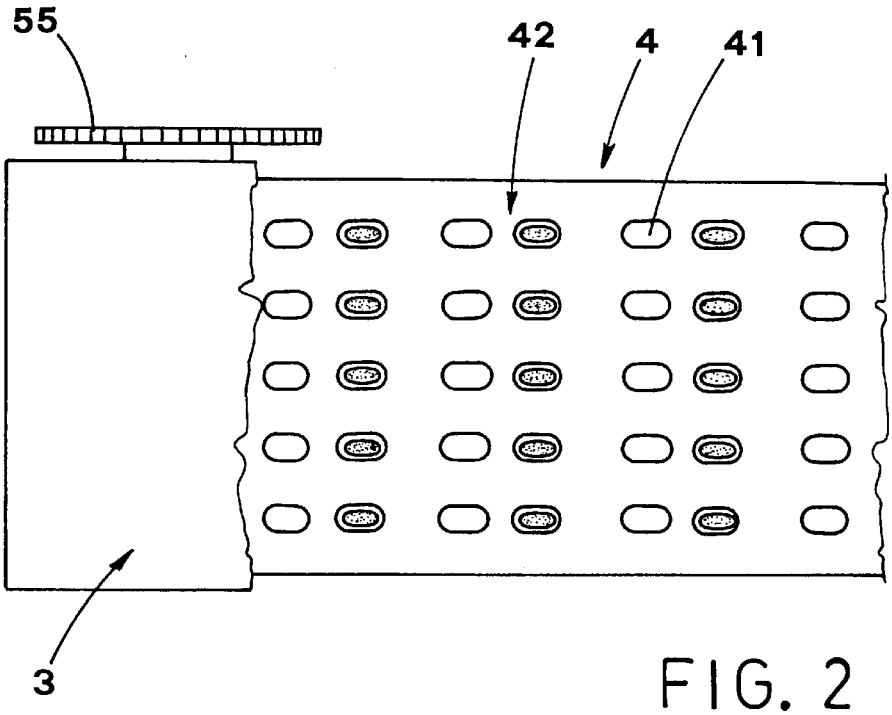
FIG. 2 is a schematic top view of the same system.
Figure 6:
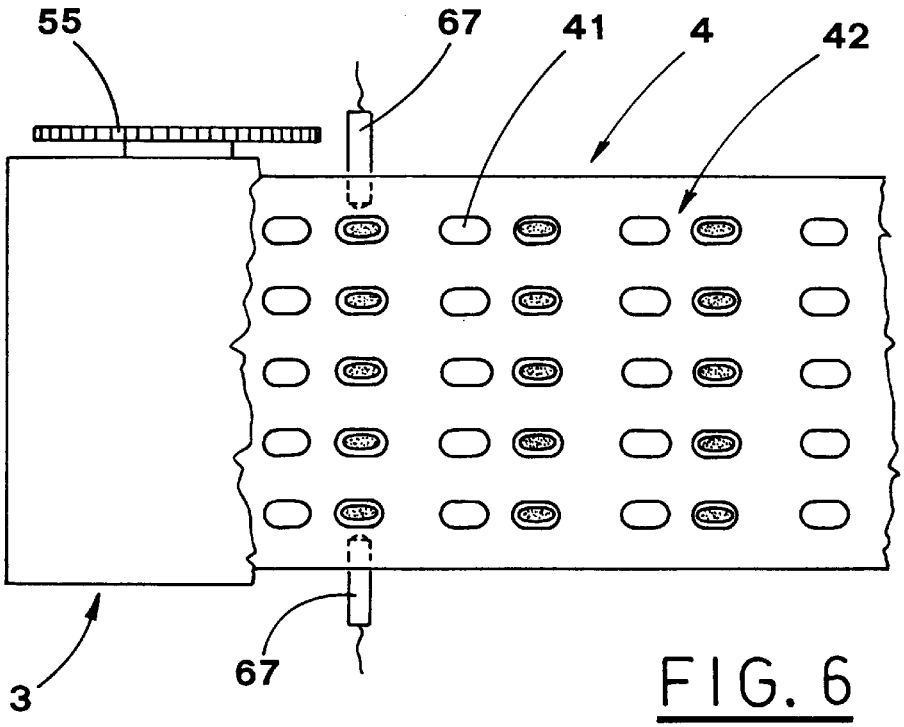
FIG. 6 is a schematic top view of this alternative embodiment of the system.
Figure 4:
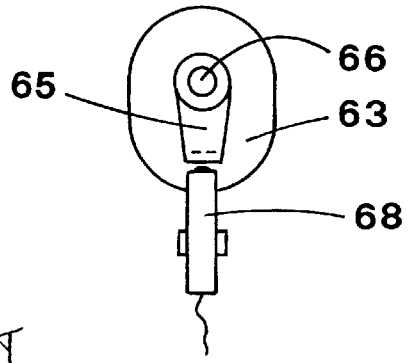
FIG. 4 is a section IV—IV of FIG. 3.

The blisters 41 are arranged in a plurality of rows 42 (see FIG. 2), the number of which, considering a fixed number of articles for each package, depends on the width of the blister band 4 and dimensions of the blisters 41.

A plurality of magazines 1, as many as the rows 42 of blisters 41 of each package, is situated above each row. Between the magazines 1 and the blister band 4 there are situated placement means 3, that cyclically take the articles 2 from the bottom 11 of the magazines 1 and introduce them inside the respective blisters 41.

The placement means include each a rotary cylindrical mantle 33, hollow inside, that faces the upper surface of the blister band 4. The outer diameter of the mantle 33 is such that its outer surface 32 touches, at the top, the bottom of the magazines 1, and at the bottom, the blister band 4.

The cylindrical mantle 33 is rotated in direction N by a motor 5, e.g. by a mechanism that includes pulleys 51,52,55 (see also FIG. 2) and toothed belts 53,54. Rotation of the mantle 33 occurs in direction N in accordance with the advancement direction M of the belt 4, and in phase relation therewith.

The surface 32 of the mantle 33 features a plurality of depressions 31, regularly spaced apart along its circumference, and situated longitudinally in correspondence of the magazines 1 and the blister rows 42. The depressions 31 are aimed at housing the articles 2.

A fixed cylinder 34 is situated inside the rotary mantle 33. Outside, the fixed cylinder 34 is formed in such a way that it defines, together with the internal surface 32*a* of the mantle 33, a first chamber 35, that is situated over the blister band 4, and inside which the pressure is kept higher than outside.

Likewise, the fixed cylinder 34 defines a second chamber 36, that extends along its part situated downstream of the magazines 1, with respect to the rotation direction N, up to the first chamber 35 and independent therefrom.

The pressure inside the second chamber 36 is lower than outside. In correspondence with each depression 31, the mantle 33 has through holes 37, that make the respective depression 31 communicate cyclically, as a consequence of the mantle rotation, with the second chamber 36 with low pressure, and therefore, with the first chamber 35, with high pressure.

It must be pointed out that the above described arrangement of the placement means 3 is merely illustrative, since only the task of these means characterises the invention.

The above mentioned motor 5 is preferably brushless, and allows, in conjunction with feedback control means 6, to control precisely the position of the cylindrical mantle 33, in order to assure that each row of depressions 31, housing articles 2, 20 matches perfectly a row 42 of blister 41 when the said articles 2 are being introduced into the blisters 41.

In order to achieve this purpose, the motor 5 and the control means 6 are connected with an electronic control unit 64.

Figure 3:
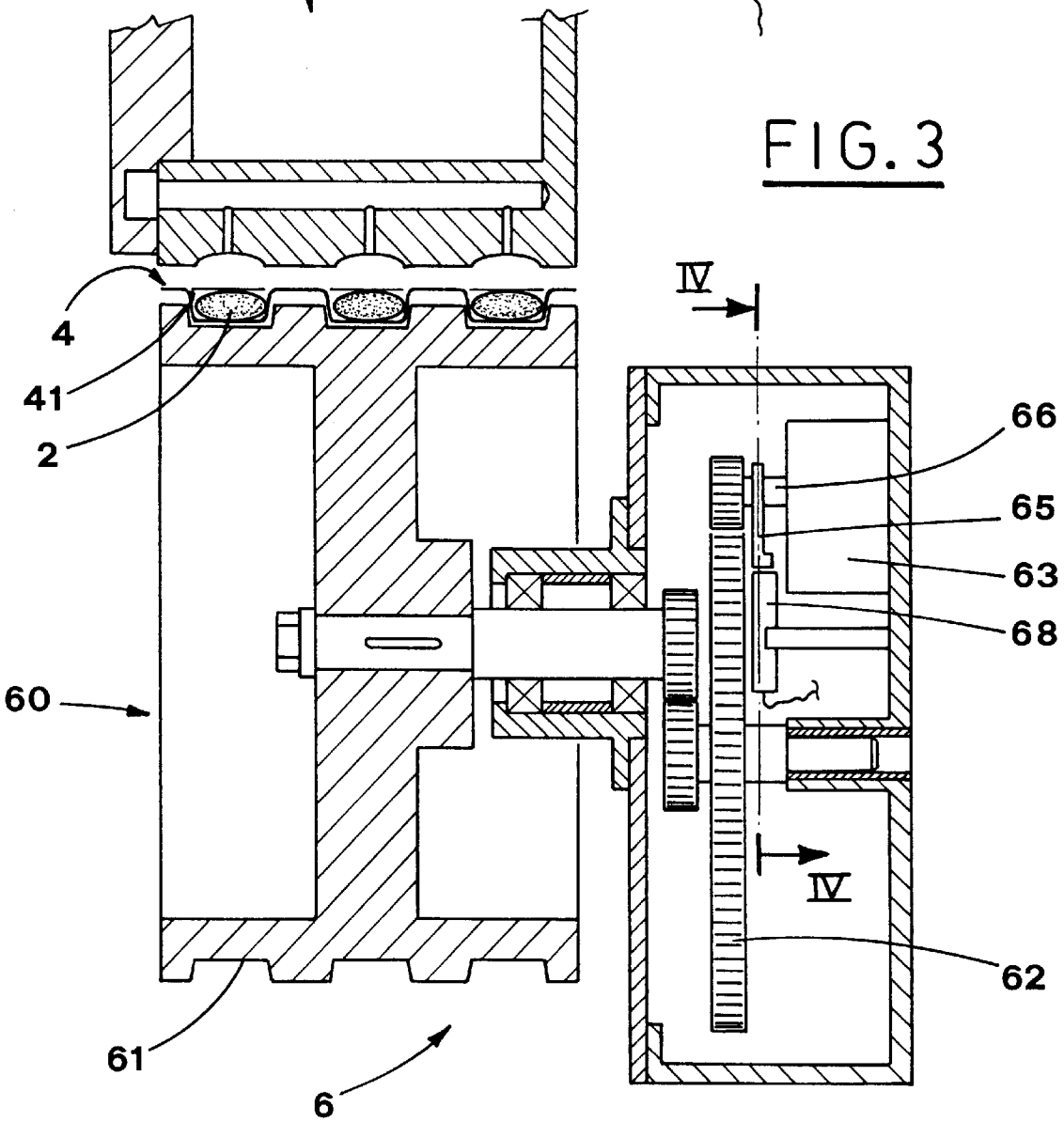
FIG. 3 is a view taken along the section III—III of FIG. 1.

In a preferred embodiment, the control means 6 include an idle roller 60, that is situated under the band 4 and opposite to the cylindrical mantle 33 (see FIGS. 1 and 3).

Along the external circumference of the roller 60, there is made a plurality of recesses 61, arranged according to the blister rows 42 in the band 4.

The recesses 61 progressively engage the blisters 41 so that the roller 60 is rotated in synchrony with the band 4. A gear transmission 62 connects the roller 60 to a position codifier 63, that detects the angular position of the roller 60 in every moment.

The gear transmission 62 is constituted by an overgear, so that the angular movements of the roller 60 are amplified.

Moreover, a proximity sensor 68, aimed at periodical clearing the position reference, is provided and operated by a cam 65, suitably keyed onto a shaft 66 of the codifier 63.

In another embodiment of the present invention (see FIG. 5), the feedback control means 6 feature a sensor 67, e.g. optical detector, connected with the electronic control unit 64, that is, in its turn, electrically connected with the motor 5.

The sensor 67 is placed on one side of the blister band 4, so that it is obscured by the blisters 41 and it detects their actual position.

Figure 5:
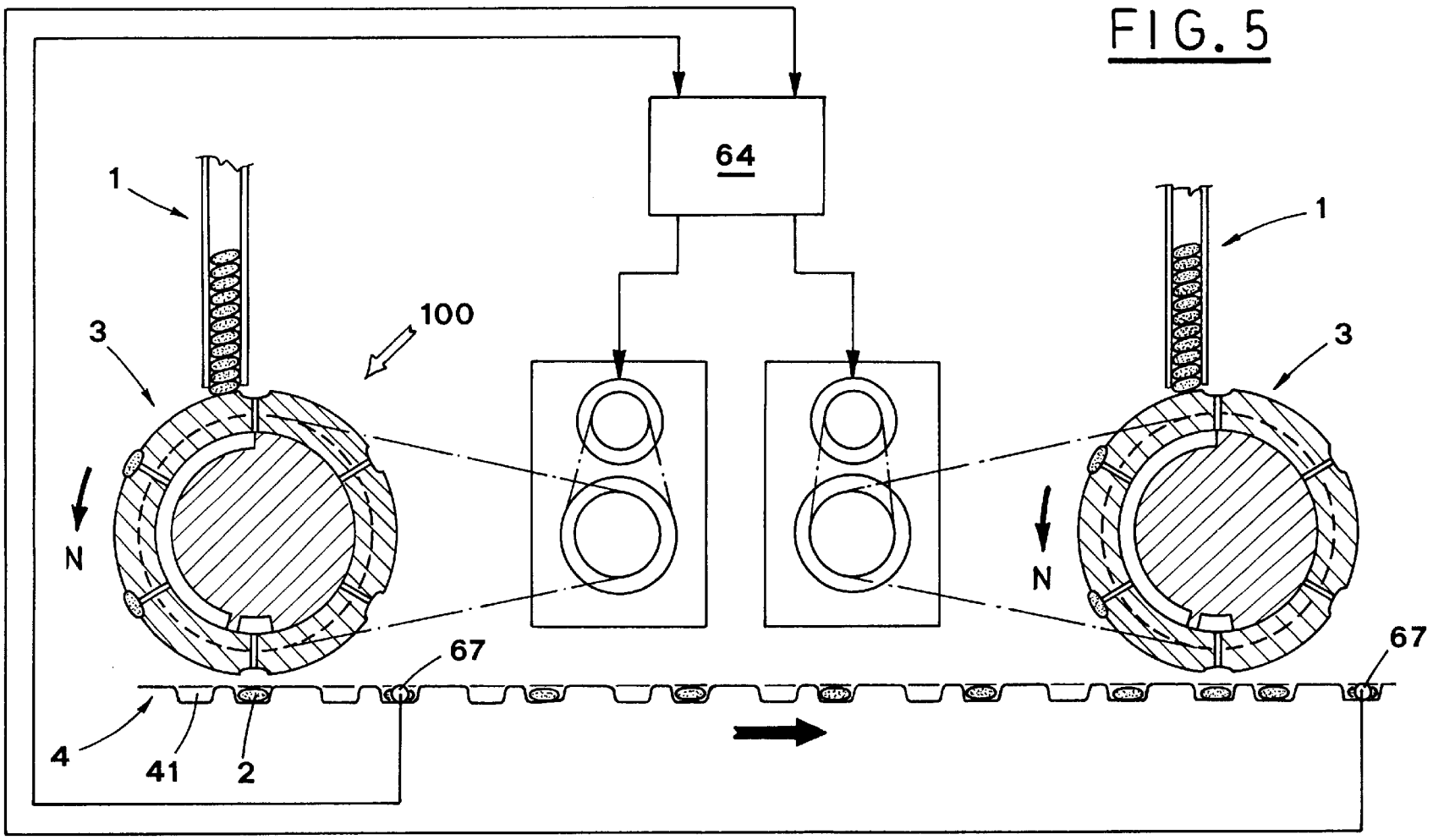
FIG. 5 is a schematic view of an alternative embodiment of the system.

The sensor 67 is situated in adjacency of the placement means 3, e.g. directly downstream thereof, as in FIG. 5, but it can be also positioned upstream thereof or right in correspondence therewith.

The feedback control means 6 allow to use blister band made of any thermoformable or cold formable materials, included the ones like polypropylene, with high temperature depending elongation and shrinkage coefficient.

FIGS. 1 and 5 show embodiments of the invention, in which the article feeding system, presented as an example, is constituted by two feeding groups, placed longitudinally with respect to the blister band 4 and working in mutual phase relation, each of which featuring a storage magazine 1, a placement cylinder 3, a brushless motor 5 and feedback control means 6.

This example is particularly advantageous when two different types of articles 2 must be introduced into the blisters 41 of the same blister pack. This often occurs in treatments that administrate alternatively an active medicine and a placebo product, with substantially psychological effect.

In this case, the two feeding groups introduce respectively the active medicine and the placebo product, according to the a predetermined schedule.

If the size of either the articles 2 or the blisters 41 varies, it is possible to change longitudinally the position of each feeding group with respect to the blister band 4.

Moreover, the reciprocal position of various elements of each feeding group can be changed by suitable means which are not shown since they are well known in the art.

Now, operation of the system for feeding articles will be described, beginning from a situation, shown in FIG. 1, in which a single article 2, situated on the bottom of the feeding channel 10, is kept in this position by the surface 32 of the rotary mantle 33.

The same situation occurs for each depression 31 of the same transversal row and for each feeding channel 10. The blister band 4 is moved in the direction M with substantially constant speed.

The position and rotation speed of the cylindrical mantle 33 are continuously changed moment by moment by the brushless motor 5, through the control unit 64, in response to information concerning the position of the blisters 41, supplied by the control means 6. Due to these changes each depression 31, during the mantle 33 rotation, locates directly over the blister band 4, in perfect register with a blister 41 to be filled.

As the mantle 33 continues to rotate, a expression 31 is brought under the channel 10, and he article 2 falls therein.

Simultaneously, the hole 37 relative to the aid depression 31 is brought to a position, in which it communicates with the second chamber 36, with negative pressure, so as to generate suction force that acts on the article 2.

During the subsequent rotation of the mantle 33, the article 2 is moved downwards and kept inside the depression 31 by the suction force.

Afterwards, the depression 31 is brought to the position in which the mantle 33 touches the blister band 4 and, simultaneously, the relative hole 37 is placed in correspondence with the first chamber 35.

The compressed air, that passes through the hole 37 and comes to the depression 31, pushes the article 2 that falls on the band 4 and therefore, inside the blister 41.

The pushing force is favourably affected by the weight of the article 2 and the centrifuge force that acts on it.

The article feeding system disclosed in the present specification allows to use blister bands made of any material, independently from its possible deformations, including plastic materials with high biodegradability and low environmental impact, such as polypropylene.

Another advantage results from the fact, that only one article is introduced into each blister; this allows to reduce the number of blister forming dies, and consequently, to lower production costs. Also rest periods of the machine due to possible size change over are limited.

A further advantage of the present invention is the possibility of considerable increase of the system productivity, because the blisters filling speed can be varied by the electronic control unit in accordance with the necessity, and because two or more feeding groups, controlled by the same electronic unit, can be installed one after the other.

Furthermore, the system has another advantage, that is the possibility of feeding the blister band 4 with articles 2 of different size or composition, or with different space arrangement within the same blister pack.

We claim:

1. System for feeding articles to blisters of a blister band, the system including: at least one magazine (1), formed by a basically vertical channel (10) with open bottom (11), containing a pile of articles (2) to be introduced into relative blisters (41) of a blister band (4) that is located under this magazine (1) and driven in a straight direction (M); the said system being characterised in that it also includes:

placement means (3), for taking cyclically at least one article (2) from the bottom (11) of said magazine (1) and for introducing it into a respective blister (41), said placement means (3) being located between the magazine (1) and the blister band (4), and rotated in a direction (N) that is in accordance with movement direction (M) of said band (4) and in phase relation therewith;

a plurality of depressions (31) made on an outer surface of said placement means (3);

a motor (5), controlled by an electronic control unit (64) for driving said placement means (3) into rotation;

feedback control means (6), electronically connected with the said control unit (64), for detecting the position of the blisters (41) and for operating said motor (5) to carry out a precise introduction of the articles (2) into respective blisters (41).

2. System for feeding articles, according to claim 1, characterised in that said feedback control means (6) feature at least one idle roller (60), featuring a plurality of recesses (61) arranged according to the blister rows (42) and aimed at being progressively engaged by said blisters (41) so as to drive the roller (60) into rotation in synchrony with the band (4), said roller (60) being connected with a position codifier (63), that detects angular positions of said roller (60) in every moment.

3. System for feeding articles, according to claim 2, characterised in that it includes also a proximity sensor (68), aimed at periodical clearing the position reference, and operated by a cam (65), suitably keyed onto a shaft (66) of said codifier (63).

4. System for feeding articles, according to claim 1, characterised in that said feedback control means (6) feature at least one sensor (67) placed on one side of said blister band (4) and adjacent to said placement means (3), so as to progressively intercept the blisters (41).

5. System for feeding articles, according to claim 1, characterised in that it includes means that change, in relation with the size of the articles and/or blisters, the reciprocal position of said feedback control means (6), placement means (3) and motor (5), as well as the position of each of these elements with respect to said blister band (4).

6. System for feeding articles, according to claim 1, characterised in that the said motor (5) is a brushless type one.

* * * * *